US006215970B1

(12) United States Patent
Yoshikawa et al.

(10) Patent No.: US 6,215,970 B1
(45) Date of Patent: Apr. 10, 2001

(54) DUPLEX UNIT WITH RECESS FOR RETRACTING MANUAL SHEET FEEDING TRAY AND IMAGE FORMING APPARATUS USING THE SAME DUPLEX UNIT

(75) Inventors: Masaaki Yoshikawa, Kawasaki; Noriaki Fukube, Souka, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/482,105

(22) Filed: Jan. 13, 2000

(30) Foreign Application Priority Data

Jan. 13, 1999 (JP) ..... 11-006378
Feb. 26, 1999 (JP) ..... 11-049745

(51) Int. Cl.[7] ..... G03G 15/00
(52) U.S. Cl. ..... 399/124; 399/392; 399/401
(58) Field of Search ..... 399/401, 124, 399/125, 110, 392; 271/225, 902

(56) References Cited

U.S. PATENT DOCUMENTS 4,453,819 * 6/1984 Wada et al. ..... 399/124
4,693,586 * 9/1987 Sumida et al. ..... 399/401
4,928,150 * 5/1990 Hatta ..... 399/401
5,219,154 6/1993 Fukube et al. ..... 271/18.2
5,316,282 5/1994 Fukube et al. ..... 271/10.07
5,564,689 10/1996 Fukube ..... 271/122
5,839,032 11/1998 Yasui et al. ..... 399/124
5,893,020 * 4/1999 Atsumi ..... 399/401 X
5,950,050 * 9/1999 Shirasaki et al. ..... 399/124

FOREIGN PATENT DOCUMENTS 8-146689 * 6/1996 (JP) .
8-202095 * 8/1996 (JP) .
10-338404 * 12/1998 (JP) .

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A duplex unit includes a case housing a sheet reverse path that connects to a sheet discharging outlet and a sheet refeed inlet provided on a side of a main body case housing an image forming unit and that is configured to reverse the sheet supplied from the sheet discharging outlet and refeed the sheet to the sheet refeed inlet. The case is rotatable around a first supporting shaft so as to be opened and closed. The duplex unit includes a manual sheet feeding tray that is rotatably supported by a horizontal second supporting shaft so as to be opened to manually feed a sheet to a manual sheet feeding inlet provided on the side of the main body case and to be closed otherwise. A recess is provided on the case so as to retract the manual sheet feeding tray into the recess without protruding from a side surface of the case when the tray is closed. The case and the manual sheet feeding tray are engaged by engaging a concave portion of the case and a convex portion of the manual sheet feeding tray.

20 Claims, 10 Drawing Sheets

DUPLEX UNIT WITH RECESS FOR RETRACTING MANUAL SHEET FEEDING TRAY AND IMAGE FORMING APPARATUS USING THE SAME DUPLEX UNIT

CROSS-REFERENCE TO RELATED APPLICATIONS

This document claims priority and contains subject matter related to Japanese Patent Application No. 11-006378 filed in the Japanese Patent Office on Jan. 13, 1999, and on Japanese Patent Application No. 11-049745 filed in the Japanese Patent Office on Feb. 26, 1999, and the entire contents of which are hereby incorporated by reference.

BACKGROUND OF THE INVENTION

1. Field of the Invention

The present invention relates to a duplex unit that reverses a sheet to form images at both sides of the sheet, for use in an image forming apparatus such as a copying machine, a facsimile, a printer, or the like.

2. Discussion of the Background

As illustrated in FIG. 12, in a background image forming apparatus for forming images on both sides of a sheet, a reverse unit 101 for reversing a sheet is provided at a side (right side as viewed in FIG. 12) of a main body case 102. The reverse unit 101 is rotatably provided around a first supporting shaft (not shown) which is provided at a lower part of the reverse unit 101 in the direction separating from the main body case 102. Below the reverse unit 101, a manual sheet feeding tray 103 that manually feeds a sheet is rotatably provided around a second supporting shaft 104 which is provided in a manual sheet feeding unit 117 in the direction separating from the main body case 102.

The main body case 102 houses sheet feeding trays 105, a sheet transfer path 109, an image forming unit 107, a fixing unit 108, and a sheet stacker unit 106. The sheet transfer path 109 is formed in the main body case 102 such that a sheet is conveyed from the sheet feeding tray 105 or the manual sheet feeding tray 103 to the sheet stacker unit 106 via the image forming unit 107 and the fixing unit 108.

In a case 110 of the reverse unit 101, a reverse path 111 and a refeed path 112 that is separated from the reverse path 111 are formed. At a separation point between the reverse path 111 and the refeed path 112, a reverse roller 113 is provided. The reverse roller 113 is reversible and conveys the sheet that is guided in the reverse path 111 to the refeed path 112 in a switchback direction. A one end of the reverse path 111 connects to the sheet transfer path 109 in the main body case 102 and the other end connects to an opening 114 that is provided at the right-hand side of the case 110 in FIG. 12 and opens outward. The opening 114 is closed by a sheet reverse guide plate 115. The sheet reverse guide plate 115 is rotatably supported around a supporting shaft 116 provided at the reverse unit 101 in the direction separating from the reverse unit 101.

In the above-described image forming apparatus with the reverse unit 101 and the manual sheet feeding unit 117, an image is formed on a sheet fed from the sheet feeding tray 105 or the manual sheet feeding tray 103 at the image forming unit 107 during the sheet passes through the sheet transfer path 109. The sheet having the image is discharged to the sheet stacker unit 106.

When images are formed on both sides of a sheet, the sheet having an image on one side is guided to the reverse path 111. When the trailing edge of the sheet passes the separation point between the reverse 111 and the refeed path 112, the reverse roller 113 is switched to rotate in the switchback direction (i.e., in the direction toward the refeed path 112), and the sheet is conveyed to the refeed path 112. The sheet is then conveyed to the sheet transfer path 109 again from the sheet refeed path 112 so as to have an image on the backside of the sheet in the image forming unit 107, and is discharged to the sheet stacker unit 106.

In the background image forming apparatus with the above-described configuration in FIG. 12, because the manual sheet feeding tray 103 is installed outside of the case 110 of the reverse unit 101 and is protruded from the case 110, people passing by the image forming apparatus may accidentally contact and break the manual sheet feeding tray 103. In addition, when an operator moves the image forming apparatus, the manual sheet feeding tray 103 may be opened due to vibration. As a result, the manual sheet feeding tray 103 may be broken by striking against surrounding items.

When a sheet is jammed in the sheet transfer path 109, an operator makes an operation space for removing the jammed sheet by rotating the reverse unit 101 around the first supporting shaft in the direction separating from the main body case 102. The operator reaches a hand into the space with the jammed sheet.

When the operator opens the reverse unit 101 for removing the jammed sheet in the sheet transfer path 109, the manual sheet feeding tray 103 needs to be opened first, and then the reverse unit 101 can be opened. On the other hand, when the operator closes the reverse unit 101 after removing the jammed sheet, the reverse unit 101 is closed first, and then the manual sheet feeding tray 103 needs to be closed. In other words, the operator needs to open and close not only the reverse unit 101 but also the manual sheet feeding tray 103 to remove the jammed sheet (i.e., the operator needs to perform two steps). The operator is therefore unnecessarily inconvenienced by opening and closing the reverse unit 101 and the manual sheet feeding tray 103 when the operator removes a jammed sheet.

Further, when a sheet having a length in the sheet conveying direction longer than the length of the reverse path 111 between the reverse roller 113 and the opening 114 (hereinafter referred to as a large size sheet) is reversed in the reverse unit 101, an operator needs to open the opening 114 by rotating the sheet reverse guide plate 115 around the supporting shaft 116 to protrude the leading edge of the large size sheet from the case 110. The open condition of the sheet reverse guide plate 115 is indicated by a dotted line in FIG. 12. In addition, when the manual sheet feeding tray 103 is closed, the operator needs to open the manual sheet feeding tray 103 first, and then rotate the sheet reverse guide plate 115 to protrude the leading edge of the large size sheet from the case 110.

Furthermore, when the operator uses an image forming apparatus installed at a place apart from an operator by a remote operation and when a large size sheet is reversed in the reverse unit 101, the operator needs to go to the image forming apparatus to rotate the sheet reverse guide plate 115 around the supporting shaft 116 and open the opening 114. Opening the sheet reverse guide plate 115 every time a large sized sheet is reversed in the reverse unit 101 becomes a burden on the operator. If an additional device for opening the sheet reverse guide plate 115 by a remote operation is installed to the image forming apparatus, an installation space and a number of construction parts increase in the image forming apparatus.

SUMMARY OF THE INVENTION

The present invention has been made in view of the above-discussed and other problems, and an object of the present invention is to address these problems.

The preferred embodiments of the present invention provide a novel duplex unit and image forming apparatus, in which a breakdown of manual sheet feeding tray caused by a protruded manual sheet feeding tray is prevented.

The preferred embodiments of the present invention provide a novel duplex unit and image forming apparatus that improve operability in opening and closing a duplex unit.

The preferred embodiments of the present invention provide a novel duplex unit and image forming apparatus that reverse various sizes of sheets efficiently without additional operations.

In order to achieve the above and other objectives, the present invention provides a novel duplex unit including a case housing a sheet reverse path that connects to a sheet discharging outlet and a sheet refeed inlet provided on a side of a main body case housing an image forming unit and that is configured to reverse the sheet supplied from the sheet discharging outlet and refeed the sheet to the sheet refeed inlet. The case is rotatable around a first supporting shaft so as to be opened and closed. The duplex unit further includes a manual sheet feeding tray that is rotatably supported by a horizontal second supporting shaft so as to be opened to manually feed a sheet to a manual sheet feeding inlet provided on the side of the main body case and to be closed otherwise. A recess is provided on the case so as to retract the manual sheet feeding tray into the recess without protruding from a side surface of the case when the tray is closed.

According to the present invention, the case and the manual sheet feeding tray may be engaged by engaging a concave portion of the case and a convex portion of the manual sheet feeding tray.

The first supporting shaft may be horizontal, and the first supporting shaft and the second supporting shaft may be located at different positions, and the concave portion may be shaped like an oblong such that a movement orbit of the convex portion resulting from a rotation of the manual sheet feeding tray always exists within an area of a movement orbit of the concave portion resulting from a rotation of the case.

According to a present invention, a depth of the concave portion may change in the longitudinal direction such that a strength of engagement of the concave portion and the convex portion when the case is opened is greater than when the case is closed.

A side wall of a portion of the concave portion where the convex portion is positioned when the manual sheet feeding tray is closed may be slanted in a direction along the movement orbit of the convex portion resulting from the rotation of the manual sheet feeding tray around the second supporting shaft.

The first supporting shaft may be arranged below the case.

According to another preferred embodiment of the present invention, an image forming apparatus includes a main body case housing an image forming unit. The image forming apparatus includes a reverse unit that has a case housing a sheet reverse path to reverse a sheet having an image formed at the image forming unit at one side of the sheet and to refeed the sheet toward the main body case. The case is rotatably supported such that the case rotates in the directions approaching and separating from a side surface of the main body case. The image forming apparatus includes a manual sheet feeding tray that is rotatably supported at one end thereof below the reverse unit and that is rotated from its closed position which is substantially vertical and parallel to a side surface of the case of the reverse unit to an open position to manually feed a sheet. A recess is formed at the side surface of the case of the reverse unit so as to retract the manual sheet feeding tray into the recess without protruding from the side surface of the case of the reverse unit when the manual sheet feeding tray is in the closed position.

According to another preferred embodiment of the present invention, an image forming apparatus includes a reverse unit including a reverse path connecting to a sheet discharging outlet that is provided on a side of the main body case and an opening opened downward at a bottom part of the reverse unit and a refeed path connecting to the reverse path and a sheet refeed inlet that is provided on the side of the main body case so as to reverse a sheet conveyed to the reverse path by feeding the sheet to the sheet refeed inlet with the trailing edge of the sheet switched to the leading edge of the sheet. The image forming apparatus includes a guide member having a guide surface, that is arranged facing the opening to guide the sheet protruded from the opening. The image forming apparatus includes a manual sheet feeding unit including a sheet feeding section having a guide surface, that is arranged facing the opening to guide the sheet protruded from the opening, and a manual sheet feeding tray that is rotatably provided at the sheet feeding section and that holds stacked sheets.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
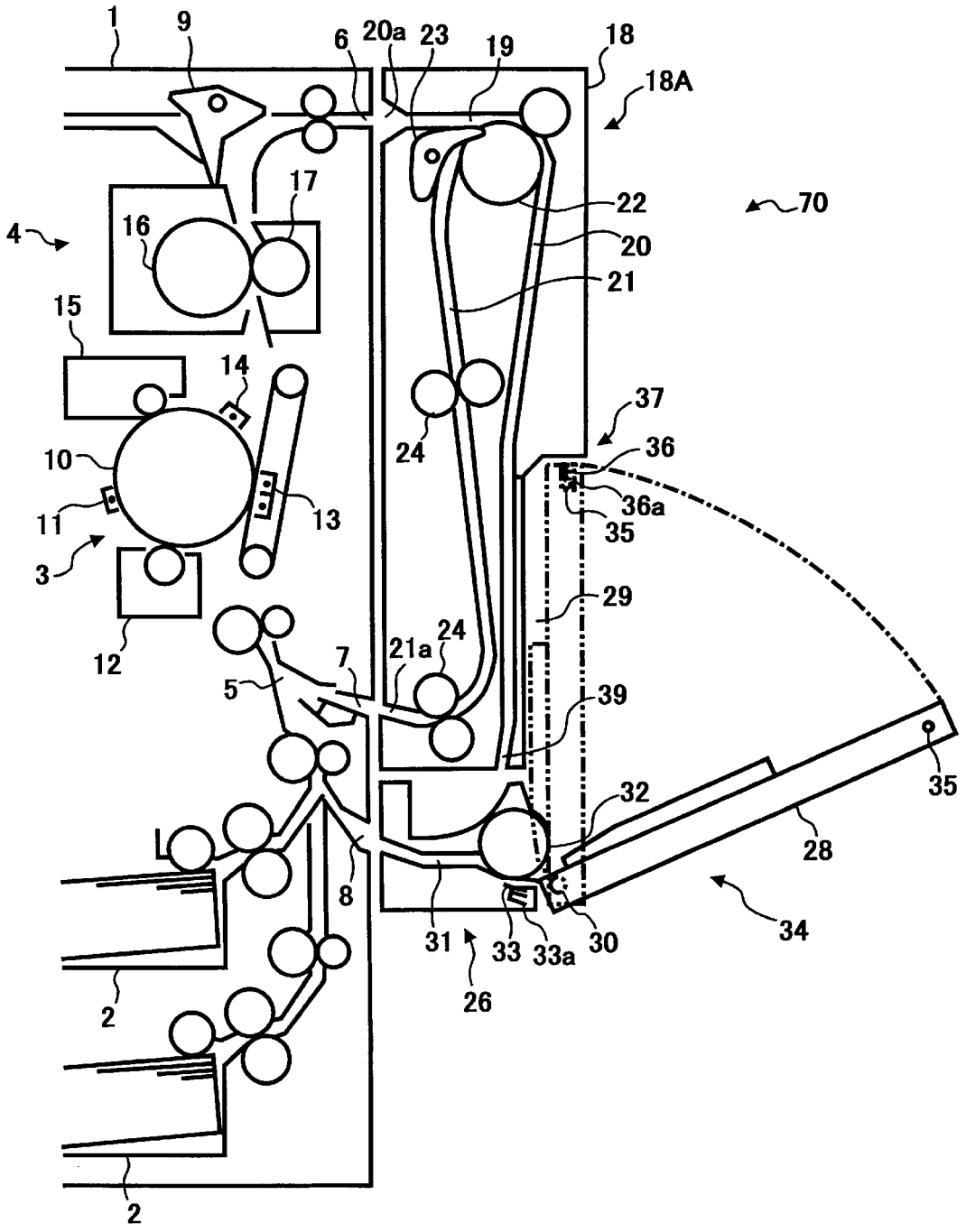
FIG. 1 is a longitudinal side view illustrating a part of an image forming apparatus with a duplex unit according to a first embodiment of the present invention.

Referring now to the drawings, wherein like reference numerals designate identical or corresponding parts throughout the several views, embodiments of the present invention employed in an electrophotographic image forming apparatus are now described. The image forming apparatus includes a main body case housing an image forming unit and a duplex unit having both a reverse unit and a manual sheet feeding unit that are installed to the main body case as an option.

A first embodiment of the present invention is described referring to FIGS. 1 through 6. FIG. 1 is a longitudinal side view illustrating a part of an image forming apparatus with a duplex unit. Referring to FIG. 1, in a main body case 1, a sheet transfer path 5 is provided such that a sheet is conveyed from a sheet feeding tray 2 to a sheet stacker unit (not shown) via an image forming unit 3 and a fixing unit 4.

On the periphery of the main body case 1, a sheet discharging outlet 6, a sheet refeed inlet 7, and a manual sheet feeding inlet 8 are provided to open toward a duplex unit 70. The sheet discharging outlet 6 is open downstream of the image forming unit 3 in the sheet conveying direction, and is located on the separated sheet transfer path 5. The sheet transfer path 5 is separated into each path toward the sheet discharging outlet 6 and toward the sheet stacker unit by a separation pick 9. The sheet refeed inlet 7 connects to the sheet transfer path 5 upstream of the image forming unit 3 in the sheet conveying direction.

Around a photoconductive element 10 located at substantially a center part of the image forming unit 3, there leave provided a charging device 11 that uniformly charges the photoconductive element 10, a developing device 12 that develops latent images, which are formed on the photoconductive element 10 by exposing an original image scanned at a scanning unit (not shown) with an exposing device (not shown), with toner to form toner images, a transfer device 13 that transfers toner images to a sheet conveyed with an appropriate timing, a discharging device 14 that discharges a surface of the photoconductive element 10, and a cleaning device 15 that removes residual toner on the photoconductive element 10.

A pressure roller 16 and a fusing roller 17 are provided in the fixing unit 4 that fixes a transferred toner image on a sheet.

Next, a reverse unit 18A is described. A case 18 of the reverse unit 18A is installed next to the main body case 1 (i.e., at the right side as viewed in FIG. 1).

On the periphery of the case 18, there are provided a sheet supply inlet 20*a* connecting to the sheet discharging outlet 6, a sheet discharging outlet 21*a* connecting to the sheet refeed inlet 7, and an opening 39 opening downward.

In the case 18, a sheet reverse path 19 is provided to reverse a sheet having an image on one side that is supplied from the sheet discharging outlet 6 and then to refeed the sheet to the sheet refeed inlet 7. The sheet reverse path 19 includes a reverse path 20 and a refeed path 21 that is separated from the reverse path 20. One end of the reverse path 20 connects to the sheet discharging outlet 6 via the sheet supply inlet 20*a*, and another end connects to the opening 39. One end of the refeed path 21 connects to a separation point between the reverse path 20 and the refeed path 21 and another end connects to the sheet refeed inlet 7 via the sheet discharging outlet 21*a*. At the separation point between the reverse path 20 and the refeed path 21, a reverse roller 22 and a separation pick 23 are provided. The reverse roller 22 is reversible and conveys a sheet that is guided to the reverse path 20 from the sheet discharging outlet 6 to the refeed path 21 in a switchback direction. The separation pick 23 switches between the reverse path 20 and the refeed path 21. On the refeed path 21, plural sets of sheet conveying rollers 24 are provided to convey a reversed sheet to the sheet refeed inlet 7.

A manual sheet feeding unit 34 is also installed next to the main body case 1 (i.e., at the right side as viewed in FIG. 1). The manual sheet feeding unit 34 includes a manual sheet feeding tray 28 that stacks sheets thereon and a sheet feeding section 26 that feeds sheets to the manual sheet feeding inlet 8. In the sheet feeding section 26, a manual sheet feeding path 31 is formed through which a sheet is conveyed from the manual sheet feeding tray 28 to the manual sheet feeding inlet 8. Further, in the vicinity of a sheet feeding exit of the manual sheet feeding tray 28, a sheet feeding roller 32 and a friction pad 33 are arranged. The sheet feeding roller 32 press-contacts a top sheet of the stacked sheets on the manual sheet feeding tray 28 to feed the sheet, and the friction pad 33 press-contacts the sheet feeding roller 32. The friction pad 33 is provided with one end of a spring 33*a* whose another end is provided with the sheet feeding section 26, and is biased in the direction of the sheet feed roller 32 by the spring 33*a*.

Figure 2:
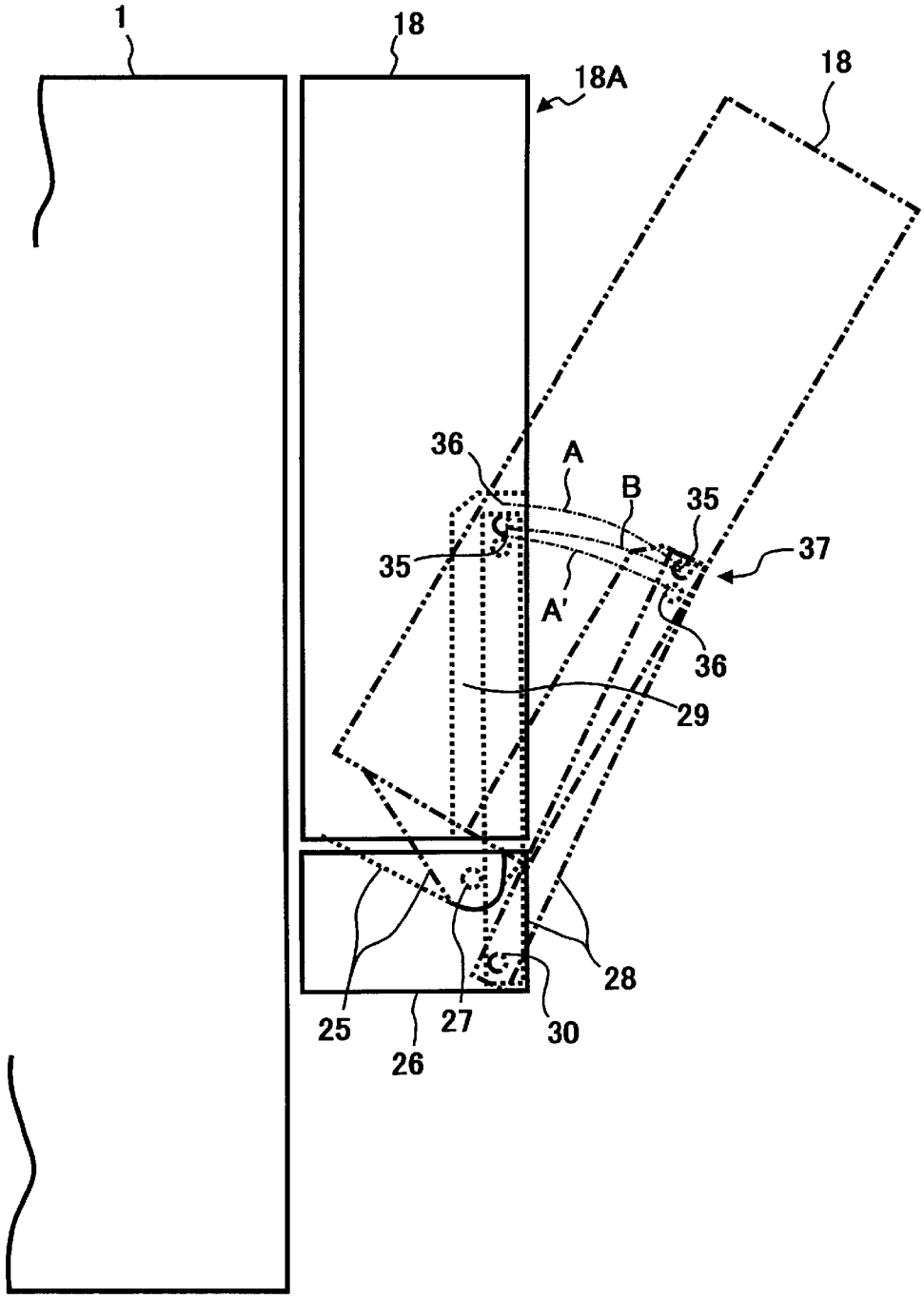
FIG. 2 is a side view illustrating rotations of a reverse unit and a manual sheet feeding tray of FIG. 1.

FIG. 2 is a side view illustrating a part of the image forming apparatus with the duplex unit 70. As illustrated by an imaginary line in FIG. 2, a pair of hinges 25 are fixed on the case 18 in a direction perpendicular to the sheet of FIG. 2 which protrudes downward from the both sides of the case 18. The hinges 25 are rotatably provided around a first supporting shaft 27 which is horizontally provided in the sheet feeding section 26.

As illustrated in FIGS. 1 and 2, on the case 18 of the reverse unit 18A, a recess 29 is provided to retract the manual sheet feeding tray 28 into the recess 29 without protruding from the side surface of the case 18. Owing to the recess 29, a breakdown of manual sheet feeding tray 28 resulting from striking against people or surrounding items is avoided. The manual sheet feeding tray 28 is rotatably provided around a second supporting shaft 30 which is horizontally provided in the sheet feeding section 26.

Figure 3A:
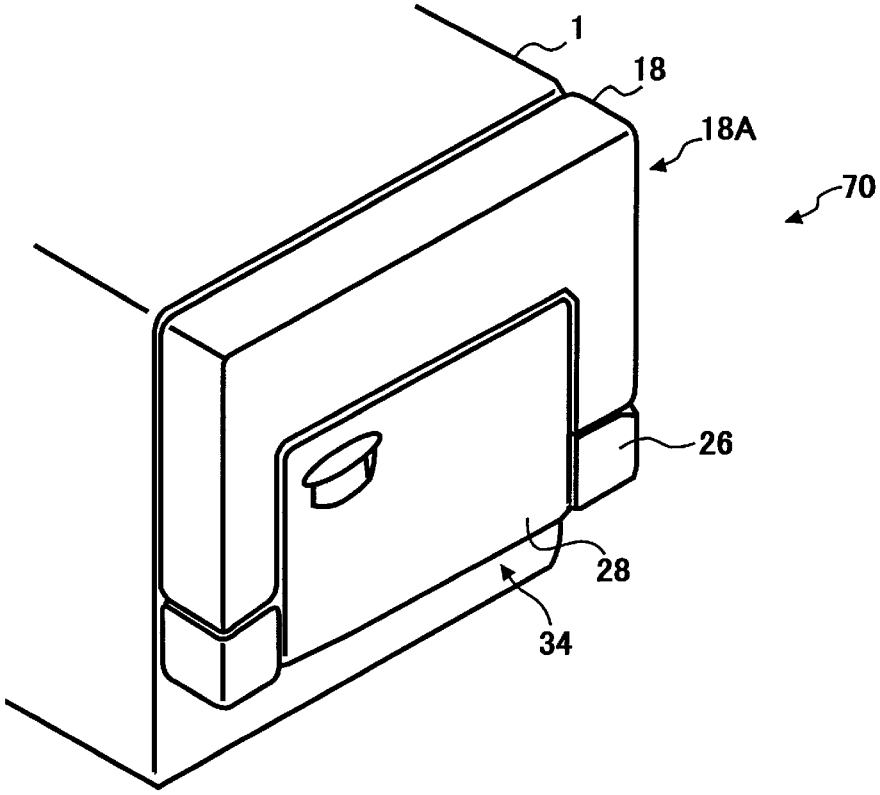
FIG. 3A is a perspective view illustrating a part of the image forming apparatus with the duplex unit of FIG. 1 in which the manual sheet feeding tray is closed.
Figure 3B:
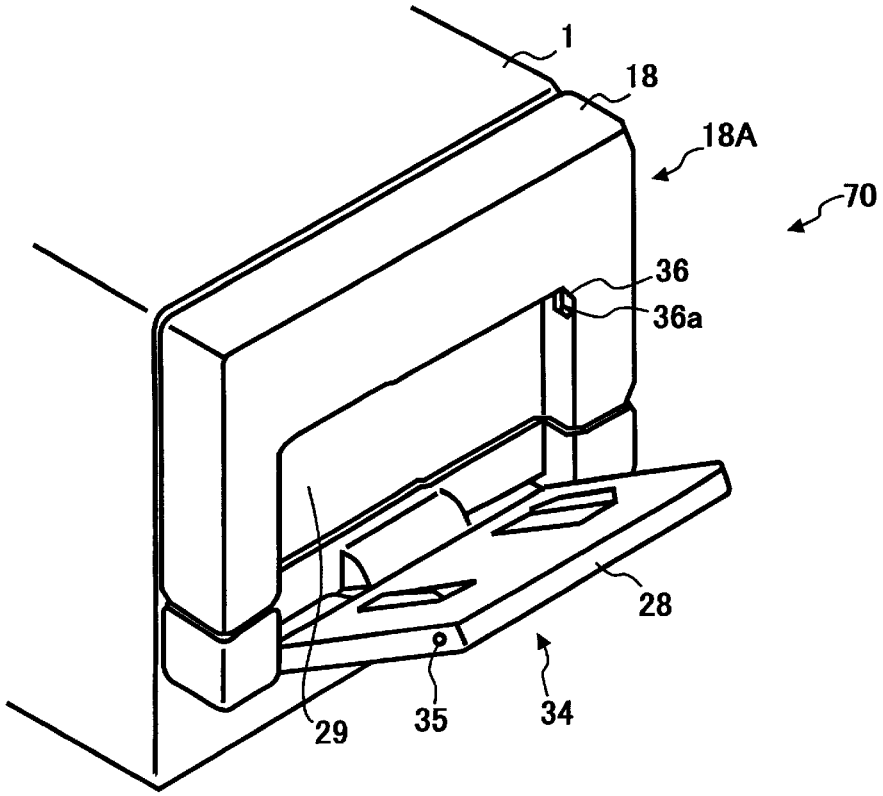
FIG. 3B is a perspective view illustrating a part of the image forming apparatus with the duplex unit of FIG. 1 in which the manual sheet feeding tray is opened.

FIGS. 3A and 3B are perspective views illustrating a part of the image forming apparatus with the duplex unit 70. In FIG. 3A, the manual sheet feeding tray 28 is closed. In FIG. 3B, the manual sheet feeding tray 28 is open.

The manual sheet feeding tray 28 and the reverse unit 18A are detachably engaged with a convex portion 35 provided on each side end of the manual sheet feeding tray 28 detachably engaged with a concave portion 36 provided in each inner side surface of the recess 29. An engaging device 37 includes the convex portion 35 and the concave portion 36.

Figure 4A:
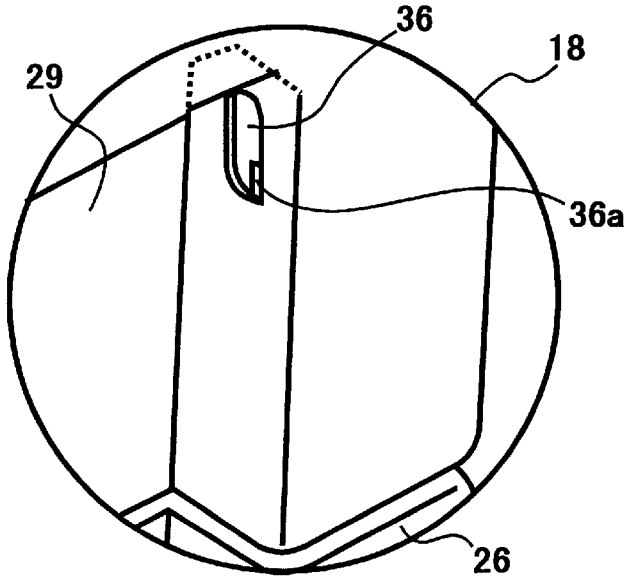
FIG. 4A is an enlarged perspective view of a concave portion.
Figure 4B:
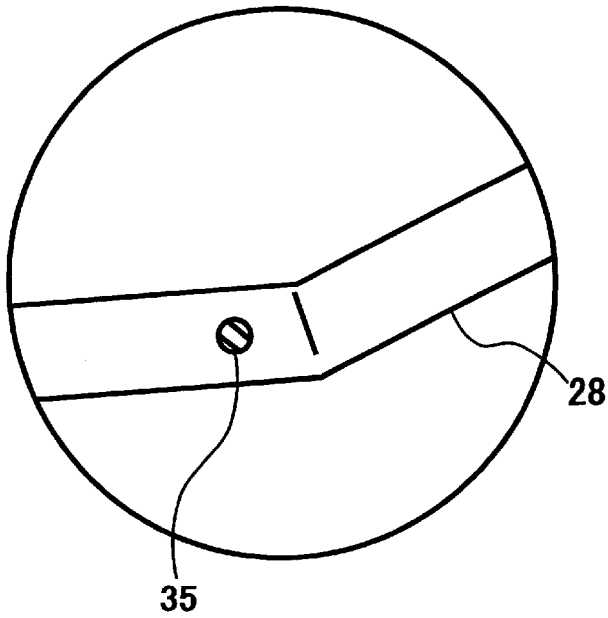
FIG. 4B is an enlarged perspective view of a convex portion.
Figure 5:
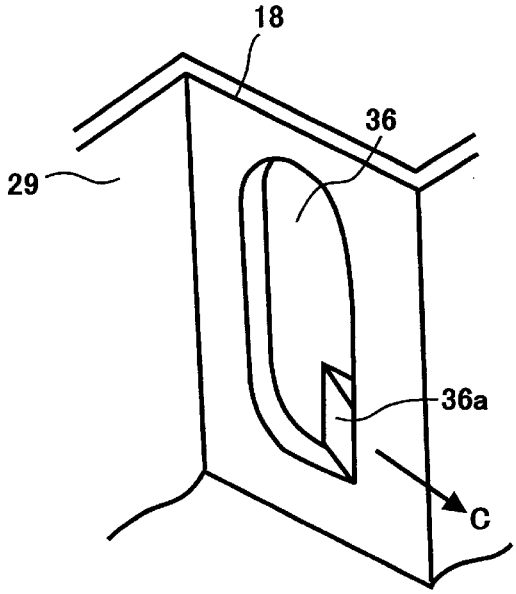
FIG. 5 is another enlarged perspective view of the concave portion.

Referring to FIGS. 4A through 6, the engaging device 37 is described. FIG. 4A is an enlarged perspective view of the concave portion 36, and FIG. 4B is an enlarged perspective view of the convex portion 35. FIG. 5 is another enlarged perspective view of the concave portion 36. FIGS. 6A and 6B are horizontal sectional views illustrating conditions when the concave portion 36 and the convex portion 35 are engaged. The concave portion 36 is shaped like an oblong. The convex portion 35 engages a part of the concave portion 36. At a lower side of the concave portion 36, a sloping surface 36*a* is formed extending from a bottom surface of the concave portion 36 in the direction of opening the manual sheet feeding tray 28. Owing to the sloping surface 36*a*, when the manual sheet feeding tray 28 is opened, the convex portion 35 is easily disengaged from the concave portion 36 by sliding on the sloping surface 36*a*. When the convex portion 35 slides on the sloping surface 36*a*, the sloping surface 36*a* and each inner side surface of the recess 29 against which the convex portion 35 abuts are pressed by the convex portion 35 and change their shapes to allow the convex portion 35 to move by the rotation of the manual sheet feeding tray 28.

In the above-described image forming apparatus with the duplex unit 70, a controller (not shown) is provided to control an image forming operation, switching operations between sheet transfer paths 5 toward the sheet stacker unit and toward the sheet discharging outlet 6, and between the reverse path 20 and the refeed path 21.

Next, an image forming operation in the image forming apparatus with the above-described configuration are described.

In the image forming unit 3, the exposing device exposes the photoconductive element 10 that is uniformly charged by the charging device 11 to form a latent image corresponding to an image of an original document scanned by the scanner unit. The latent image is developed with charged toner to form a toner image on the photoconductive element 10. The toner image is transferred to a sheet that is conveyed from the sheet feeding tray 2 or the manual sheet feeding tray 28 with an appropriate timing, when the sheet is biased during passing the transfer device 13. Then, the toner image transferred to the sheet is fixed thereon when the sheet passes through the fixing unit 4, i.e., between the pressure roller 16 and the fusing roller 17.

When an image is formed on only one side of the sheet, the sheet passed through the fixing unit 4 is conveyed to the sheet stacker unit.

When images are formed on both sides of the sheet, the sheet having an image on one side is conveyed from the fixing unit 4 to the sheet discharging outlet 6 by switching the separation pick 9. Then, the sheet is conveyed to the reverse path 20 from the sheet supplying inlet 20*a* while rotating the reverse roller 22 in the forward direction (i.e., in the direction toward the reverse path 20). When the trailing edge of the sheet passes the separation pick 23, the separation pick 23 switches to the position in which the refeed path 21 connects to the reverse path 20. When the trailing edge of the sheet in the reverse path 20 abuts on the reverse roller 22, the reverse roller 22 is switched to rotate in the switch-back direction (i.e., in the direction toward the refeed path 21). As a result of switching the rotation of the reverse roller 22, the sheet is conveyed from the reverse path 20 to the refeed path 21. The reversed sheet is refeed to the sheet transfer path 5 via the sheet refeed inlet 7 by the transfer rollers 24.

The sheet conveyed to the sheet transfer path 5 is further conveyed to the image forming unit 3 with an appropriate timing. In the image forming unit 3, a toner image, which is formed on the photoconductive element 10 by the above-described image forming operations for the backside of the sheet, is transferred to the backside of the sheet and fixed on the sheet in the fixing unit 4.

The sheet having images on both sides is conveyed to the sheet stacker unit by switching the separation pick 9 to the position in which the sheet transfer path 5 connects to the sheet stacker unit.

Next, an image is formed on a sheet fed from the manual sheet feeding tray 28 as follows. First, the manual sheet feeding tray 28 is rotated around the second supporting shaft 30 in the direction separating from the case 18, from the closed position indicated by a two-dots-and-dash line to the opened position indicated by a solid line in FIG. 1. By this rotation of the manual sheet feeding tray 28, the convex portion 35 slides on the sloping surface 36*a* in the direction indicated by an arrow C in FIG. 5, and then the case 18 and the manual sheet feeding tray 28 become disengaged. When the manual sheet feeding tray 28 is rotated to the predetermined position, the manual sheet feeding path 31 connects the manual sheet feeding tray 28 to the sheet transfer path 5. As a result of rotating the sheet feeding roller 32, friction is produced between the sheet feeding roller 32 and a sheet, and is used to convey the sheet toward the sheet transfer path 5. A single sheet or plural sheets are conveyed from the manual sheet feeding tray 28 and abut on the friction pad 33. When plural sheets abut on the friction pad 33, the sheets other than the top sheet are caused to stop proceeding due to friction caused by the friction pad 33. Therefore, only the top sheet is conveyed by the sheet feeding roller 32 to the sheet transfer path 5 through the manual sheet feeding path 31. After the sheet is conveyed to the sheet transfer path 5 from the manual sheet feeding tray 28, images are formed by the above-described image forming operations on one side or two sides of the sheet, and the sheet is discharged to the sheet stacker unit.

Next, referring to FIG. 2, a sheet removal operation when a sheet is jammed in the sheet transfer path 5 is described. First, the case 18 of the reverse unit 18A is rotated around the first supporting shaft 27 in the direction separating from the main body case 1. Subsequently, the manual sheet feeding tray 28 is pushed by the case 18 and starts rotating around the second supporting shaft 30 in the direction separating from the main body case 1 together with the case 18.

By the above-described rotations of the case 18 and the manual sheet feeding tray 28, the relative positions of the convex portion 35 and the concave portion 36 change because each rotation center of the case 18 and the manual sheet feeding tray 28 is different. Specifically, as illustrated in FIG. 2, as a result of rotating the case 18 around the first supporting shaft 27, the concave portion 36 moves along an arcuate line having a radius equal to the distance between the first supporting shaft 27 and the concave portion 36. A reference character A designates a movement orbit of an upper edge of the concave portion 36 (hereinafter referred to as a movement orbit A), and a reference character A' designates a movement orbit of a lower edge of the concave portion 36 (hereinafter referred to as a movement orbit A'). Further, the convex portion 35 of the manual sheet feeding tray 28 that is engaged with the concave portion 36 moves along an arcuate line having a radius equal to the distance between the second supporting shaft 30 and the convex portion 35. A reference character B designates a movement orbit of the convex portion 35 (hereinafter referred to as a movement orbit B). When the case 18 is closed, the convex portion 35 positions at a lower end of the concave portion 36. As the case 18 is rotated to open, the convex portion 35 slides upward along the concave portion 36 from the lower end to the upper end of the concave portion 36. While the case 18 rotates from the closed position to the open position, the movement orbit of the convex portion 35 (movement orbit B) always exists within an area of the movement orbit of the concave portion 36 (area between movement orbit A and movement orbit A'). Owing to the above-described configuration of the engaging device 37 including the convex portion 35 and the concave portion 36, even though the reverse unit 18A and the manual sheet feeding tray 28 rotate and the relative position of the reverse unit 18A and the manual sheet feeding tray 28 is displaced, the reverse unit 18A and the manual sheet feeding tray 28 can be maintained to be engaged. Thereby, the sheet transfer path 5 can be opened by rotating the case 18 of the reverse unit 18A in the direction separating from the main body case 1 with the reverse unit 18A and the manual sheet feeding tray 28 engaged. Owing to the engaging device 37, an operator can open the reverse unit 18A efficiently without additional operation of moving the manual sheet feeding tray 28 beforehand. Therefore, operability is increased.

After rotating the case 18 to the open position, an operator removes a jammed sheet in the sheet transfer path 5 by reaching into the open space with a hand.

Next, an operation for closing the case 18 after removing a jammed sheet is described. First, the case 18 is rotated around the first supporting shaft 27 towards the main body case 1 from the open position. At this time, the manual sheet feeding tray 28 moves together with the case 18 because the manual sheet feeding tray 28 is engaged with the case 18 by the engaging device 37, and rotates around the second supporting shaft 30 towards the main body case 1. Because each rotation center of the case 18 and the manual sheet feeding tray 28 is different, the relative positions of the concave portion 36 and the convex portion 35 change by rotating the case 18 and the manual sheet feeding tray 28. Specifically, in the engaging device 37, the convex portion 35 slides downward in the concave portion 36 from the upper end to the lower end. Owing to the above-described configuration of the engaging device 37, the case 18 and the manual sheet feeding tray 28 rotate together with the case 18 and the manual sheet feeding tray 28 engaged.

Figure 6A:
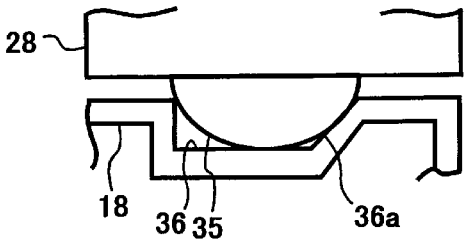
FIGS. 6A and 6B are horizontal sectional views illustrating conditions when the concave portion and the convex portion are engaged.

When the case 18 is closed, the concave portion 36 and the convex portion 35 are engaged between one side wall of the concave portion 36 and the sloping surface 36*a* as illustrated in FIG. 6A. Even if the image forming apparatus is moved by an operator, the manual sheet feeding tray 28 is prevented from being disengaged from the case 18 by vibration. On the other hand, when the manual sheet feeding tray 28 is drawn from the recess 29 and is opened in the direction indicated by the arrow C in FIG. 5, the convex portion 35 and the concave portion 36 are disengaged easily by sliding on the sloping surface 36*a,* so that the manual sheet feeding tray 28 is allowed to rotate smoothly.

Figure 6B:
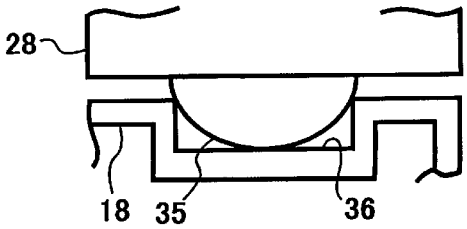

When the case 18 is opened with the manual sheet feeding tray 28 engaged with the case 18, the convex portion 35 of the manual sheet feeding tray 28 moves to the upper end of the concave portion 36. As illustrated in FIG. 6B, the convex portion 35 is engaged between the side walls of the concave portion 36 at the upper end of the concave portion 36. Because the convex portion 35 is engaged with the concave portion 36 securely at the upper end of the concave portion 36, the manual sheet feeding tray 28 does not happen to be opened while an operator removes the jammed sheets.

When the reverse unit 18A is rotated outward around the first supporting shaft 27 for removing a jammed sheet in the sheet transfer path 5, because the first supporting shaft 27 is arranged below the reverse unit 18A and at the position separating from the main body case 1, a lower part of an inner surface (i.e., a surface facing the main body case 1) of the case 18 is caused to be much separated from the main body case 1. Therefore, enough space for removing the jammed sheet is provided, so that the jammed sheet is smoothly removed. Further, in the above-described arrangement of the first supporting shaft 27, because the center of gravity of the reverse unit 18A is positioned closer to the main body case 1 relative to the center of the first supporting shaft 27, the reverse unit 18A can lean toward the main body case 1 with the assistance of the mass of the reverse unit 18A. As a result, when a lock mechanism (not shown) for locking the reverse unit 18A in the vertical position is installed in the reverse unit 18A, a simple and low-cost lock mechanism can be employed.

In the above-described image forming apparatus according to the first embodiment of the present invention, the convex portion 35 and the concave portion 36 may be interchangeable between the case 18 and the manual sheet feeding tray 28.

Alternatively, the first supporting shaft 27 and the second supporting shaft 30 may position at the same place, if the common shaft has enough strength for supporting both the reverse unit 18A and the manual sheet feeding unit 34.

Figure 7:
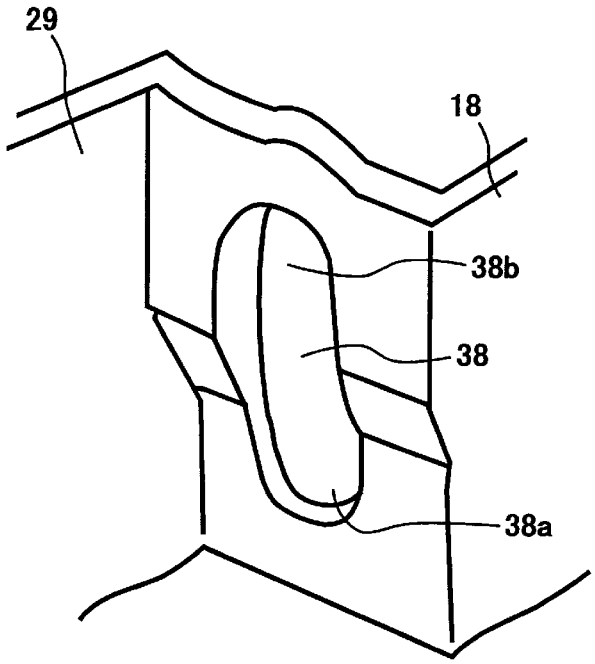
FIG. 7 is an enlarged perspective view of a concave portion according to a second embodiment of the present invention.
Figure 8A:
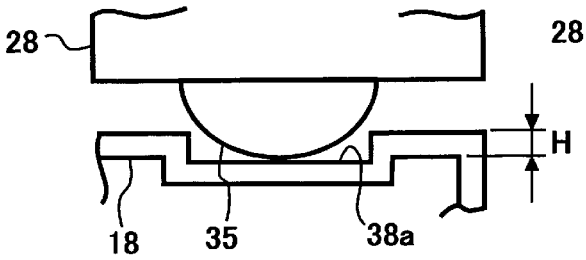
FIGS. 8A and 8B are horizontal sectional views illustrating conditions when the concave portion and the convex portion are engaged in the second embodiment of the present invention.
Figure 8B:
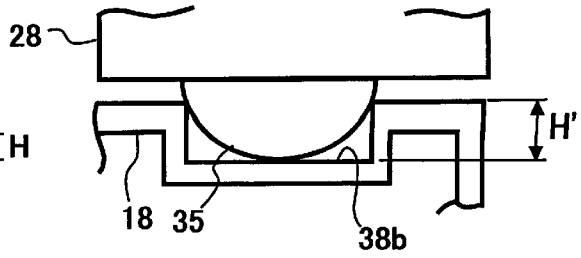

Next, a second embodiment of the present invention is described referring to FIG. 7 and FIGS. 8A and 8B. FIG. 7 is an enlarged perspective view of a concave portion. FIGS. 8A and 8B are horizontal sectional views illustrating conditions when the concave portion and the convex portion are engaged.

For the sake of simplification of the description, the members having substantially the same functions as the ones used in the first embodiment are designated with the same reference numeral and their descriptions are omitted.

The elements of the image forming apparatus of the second embodiment are substantially the same as those of the first embodiment except a concave portion 38 formed in each inner side surface of the recess 29.

The concave portion 38 is shaped like an oblong, and includes a shallow part 38*a* located at a lower end of the concave portion 38 and a deep part 38*b* located at an upper end of the concave portion 38.

When the reverse unit 18A is closed, the convex portion 35 is located at the lower end of the concave portion 38 and at the shallow part 38*a.* As illustrated in FIG. 8A, at the lower end of the concave portion 38, a depth H of the side walls of the concave portion 38 is small, so a strength of engagement between the concave portion 38 and the convex portion 35 is small. Therefore, the manual sheet feeding tray 28 can be drawn from and retracted in the recess 29 easily by hand operation by an operator.

On the other hand, when the reverse unit 18A is opened in the direction separating from the main body case 1, the convex portion 35 is located at the upper end of the concave portion 38 and at the deep part 38*b*. As illustrated in FIG. 8B, at the upper end of the concave portion 38, a depth H' is greater than the depth H, so a strength of engagement between the concave portion 38 and the convex portion 35 is great. Therefore, the manual sheet feeding tray 28 can be prevented from being opened accidentally.

Also in the image forming apparatus of the second embodiment, the convex portion 35 and the concave portion 38 may be interchangeable between the case 18 and the manual sheet feeding tray 28.

Figure 9:
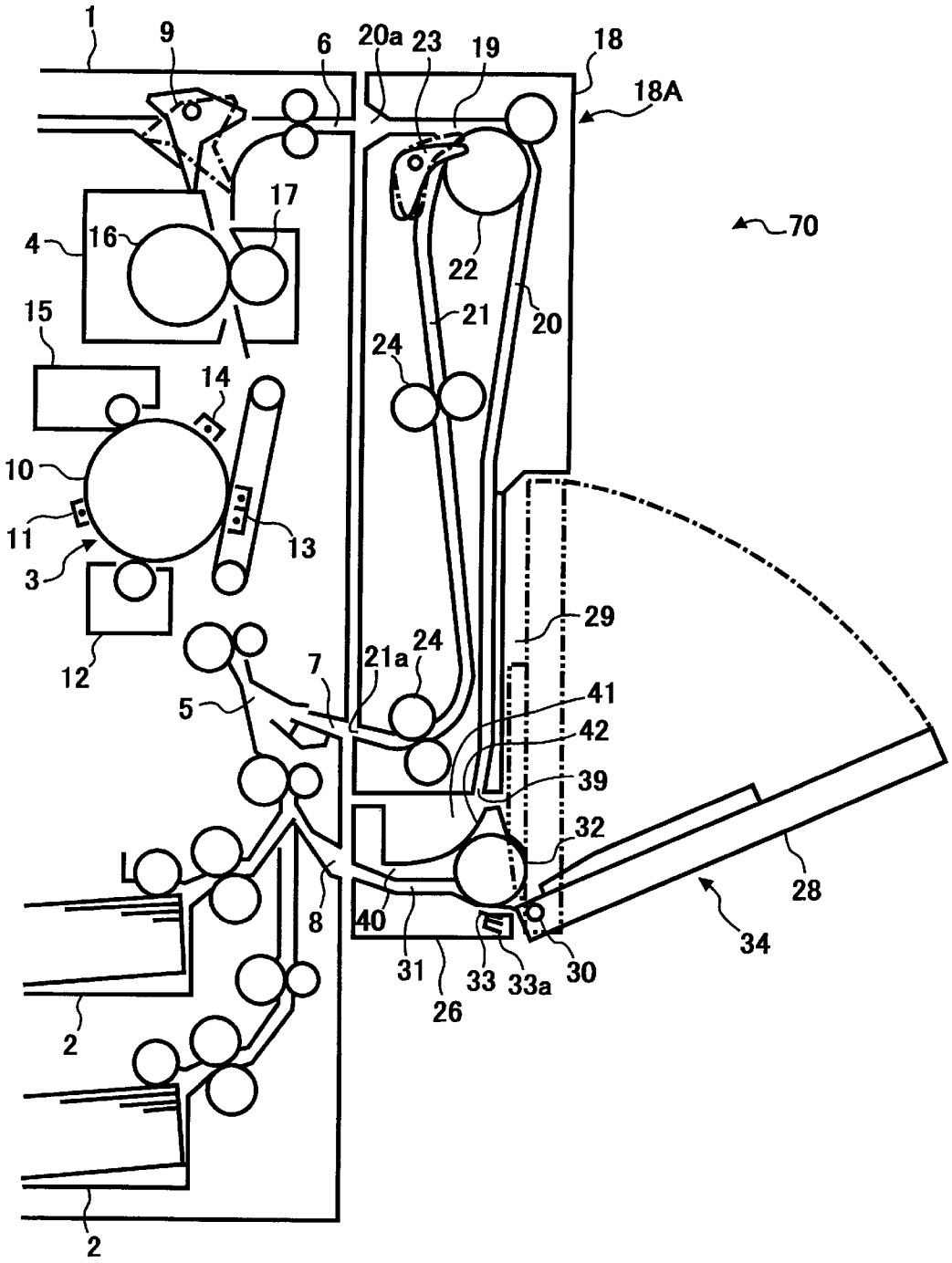
FIG. 9 is a longitudinal side view illustrating a part of an image forming apparatus with a duplex unit according to a third embodiment of the present invention.

Next, the third embodiment of the present invention is described referring to FIG. 9. FIG. 9 is a longitudinal side view illustrating a part of an image forming apparatus with a duplex unit.

For the sake of simplification of the description, the members having substantially the same functions as the ones used in the first and second embodiments are designated with the same reference numeral and their descriptions are omitted.

The image forming apparatus in the third embodiment also includes the main body case 1 housing the image forming unit 3 and the duplex unit 70 having both the reverse unit 18A and the manual sheet feeding unit 34, that is installed to the main body case 1 as an option. The case 18 of the reverse unit 18A houses the reverse path 20 in which the opening 39 is formed at the lower edge of the reverse path 20. The length of the reverse path 20 from the reverse roller 22 to the opening 39 is set to the length of the sheet in the sheet conveying direction which is most frequently used, and is set to be shorter than the length of a large size sheet in the sheet conveying direction which is not frequently used (the sheet whose length in the sheet conveying direction is longer than the length of the reverse path 20 from the reverse roller 22 to the opening 39 is referred to as a large size sheet hereinafter). This is because the height of the reverse unit 18A is limited to provide a space for installation of the manual sheet feeding unit 34 below the reverse unit 18A.

A guide member 40 facing the opening 39 is integrally formed with the sheet feeding section 26 of the manual sheet feeding unit 34. The guide member 40 includes a cutaway portion 41 having a curved guide surface 42 which descends toward the main body case 1 below the opening 39 and guides the sheet protruded from the opening 39.

In the above-described image forming apparatus with the duplex unit 70 of the third embodiment, the large size sheet is reversed as follows.

Figure 12:
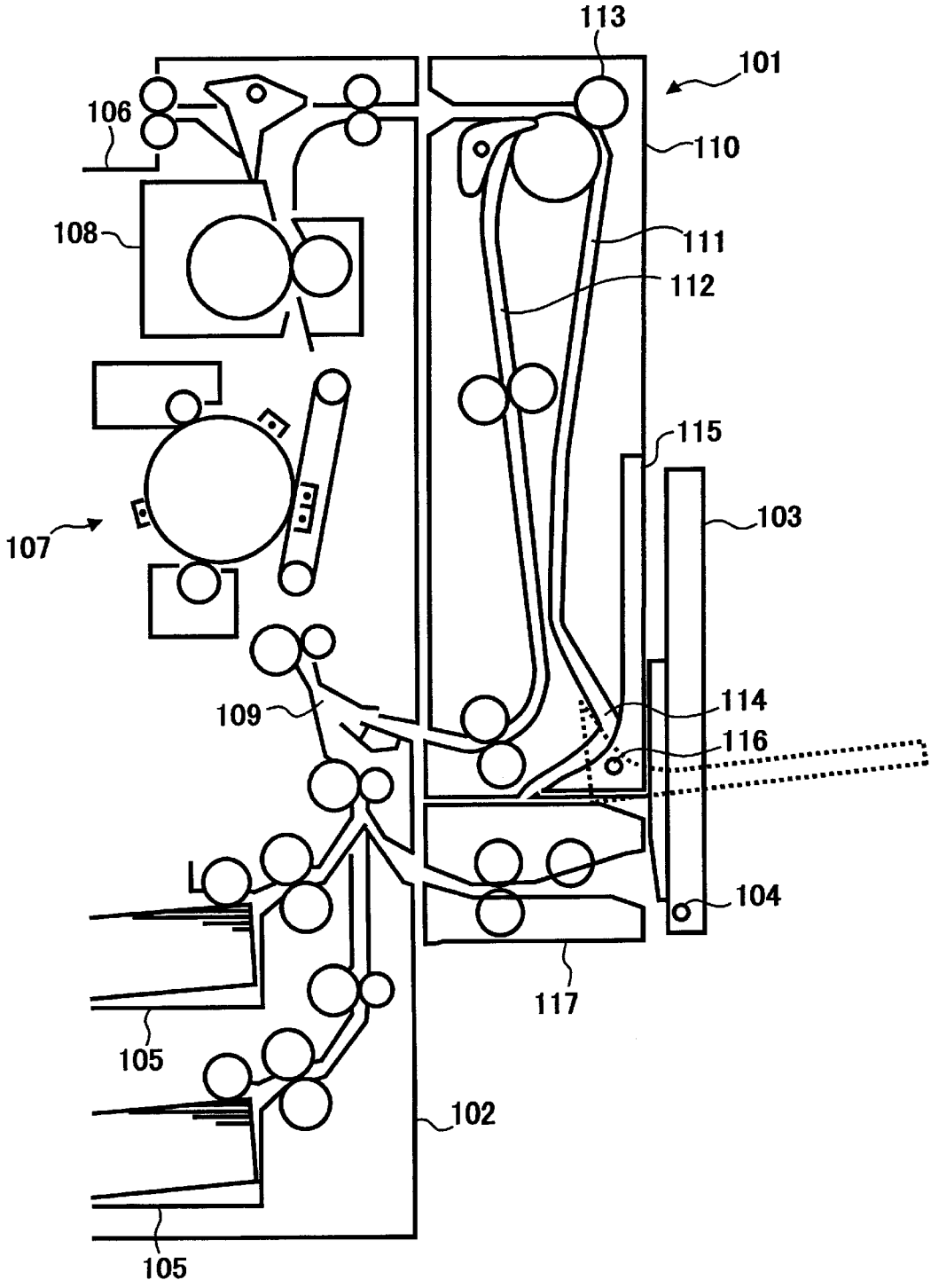
FIG.12 BACKGROUND ART
FIG. 12 is a longitudinal side view illustrating a part of a background image forming apparatus with a duplex unit.

When the large size sheet is conveyed to the reverse path 20, a leading edge of the sheet is protruded from the opening 39. Because the opening 39 opens downward at the bottom part of the reverse unit 18A, the sheet protrudes downward from the opening 39 without protruding from the side of the reverse unit 18A like the background image forming apparatus illustrated in FIG. 12. The leading edge of the sheet protruded from the opening 39 enters the cutaway portion 41 and is guided toward the main body case 1 along the curved guide surface 42.

In the image forming apparatus with the duplex unit 70 of the above-described configuration, various sizes of sheets can be reversed without enlarging the installation space of the image forming apparatus and without additional operations for opening the opening 39 and making space for the protruded sheet. Moreover, because the guide member 40 is integrally provided with the sheet feeding section 26 of the manual sheet feeding unit 34, various sizes of sheets can be reversed in a simple configuration without increasing a number of construction parts.

Further, because the sheet stacked on the manual sheet feeding tray 28 is separated and fed one by one by the sheet feeding roller 32 and the friction pad 33 toward the sheet transfer path 5, a sheet separation/feeding mechanism can be made compact in the sheet feeding section 26. In addition, because the sheet feeding roller 32 and the friction pad 33 are provided in the vicinity of a sheet feeding exit of the manual sheet feeding tray 28, a space downstream of the sheet feeding roller 32 and the friction pad 33 and above the manual sheet feeding path 31 can be provided to form the guide member 40 for the large size sheet.

Figure 10:
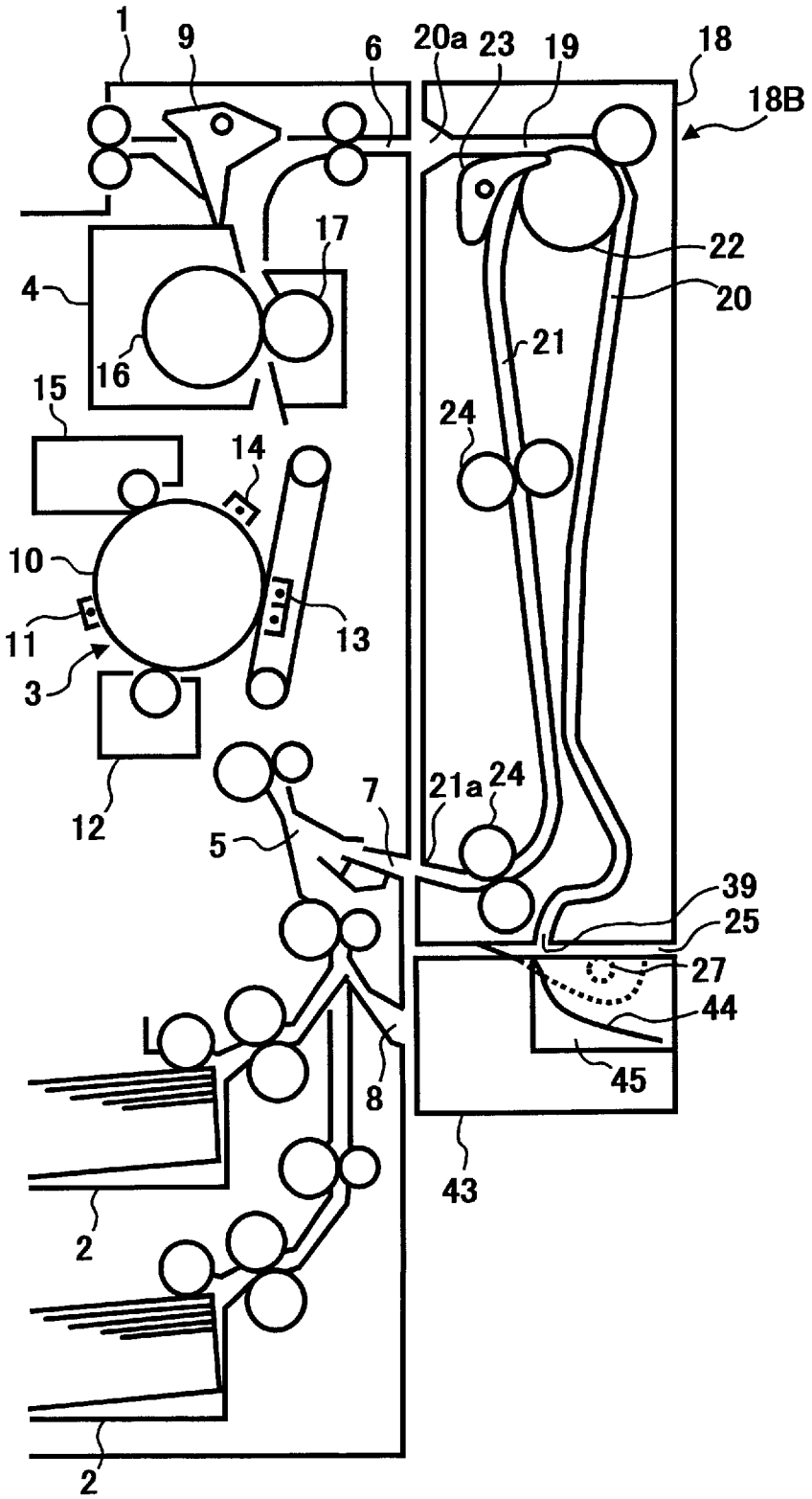
FIG. 10 is a longitudinal side view illustrating a part of an image forming apparatus with a duplex unit according to a fourth embodiment of the present invention.
Figure 11:
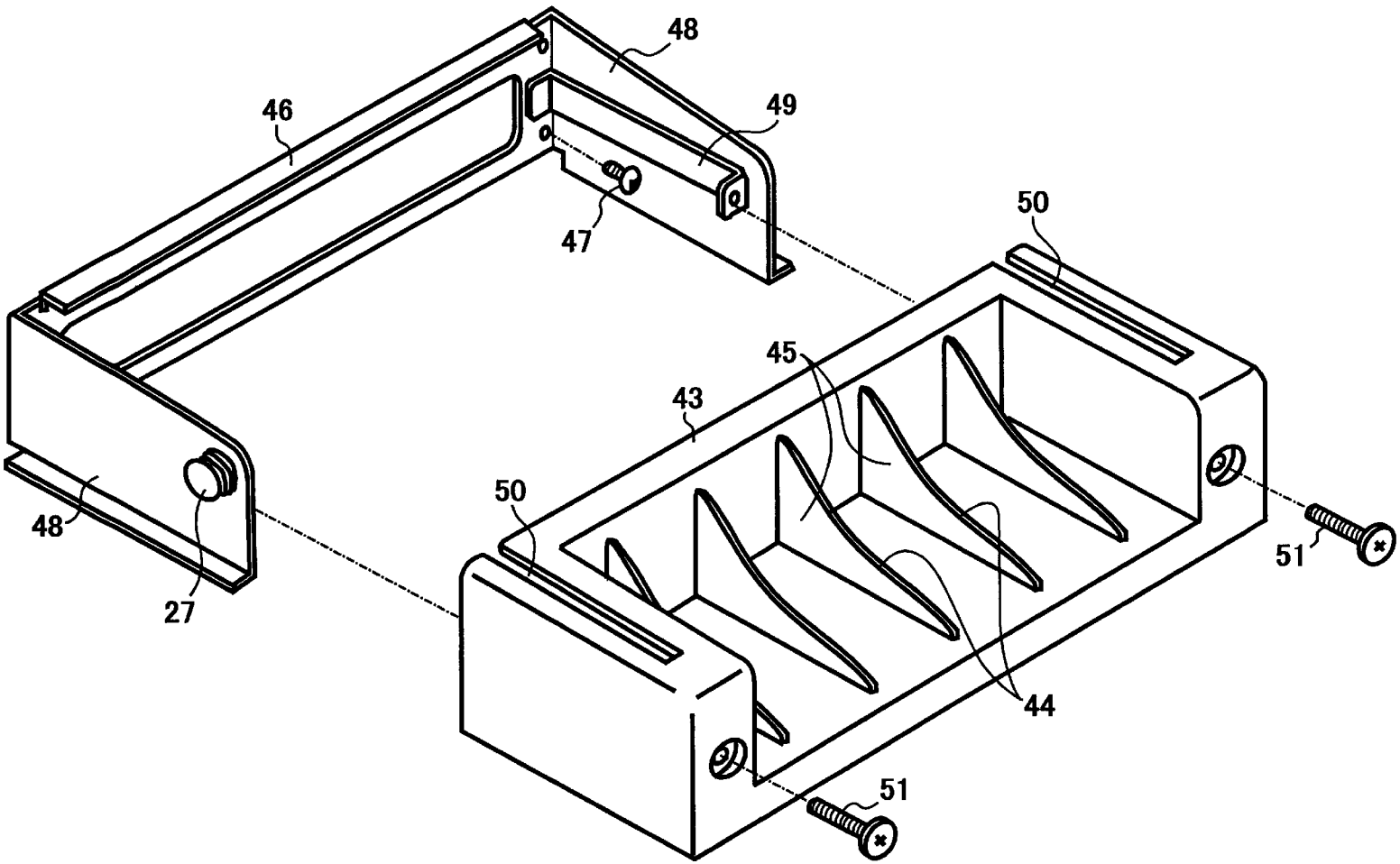
FIG. 11 is an exploded perspective view illustrating a bracket and a guide member according to the fourth embodiment of the present invention.

Next, the fourth embodiment of the present invention is described referring to FIGS. 10 and 11. FIG. 10 is a longitudinal side view illustrating a part of an image forming apparatus with a duplex unit. FIG. 11 is an exploded perspective view illustrating a bracket and a guide member. For the sake of simplification of the description, the members having substantially the same functions as the ones used in the first through third embodiments are designated with the same reference numeral and their descriptions are omitted.

The image forming apparatus in the fourth embodiment does not include a manual sheet feeding unit. However, a guide member 43 facing the opening 39 of the reverse path 20 is provided below a reverse unit 18B. In the guide member 43, a curved guide surface 44 is formed to guide the large size sheet protruded from the opening 39 to reverse. As illustrated in FIG. 11, a plurality of curved guide surfaces 44 are made of entire upper curved surfaces of plural ribs 45 which are integrally formed with the guide member 43. A reference numeral 46 in FIG. 11 indicates a bracket that is mounted on the side of the main body case 1 with screws 47. On the outside of bent portions 48 which are formed on both sides of the bracket 46, the pair of first supporting shafts 27 are installed so as to rotatably support the hinges 25 mounted on both sides of the case 18. In addition, installation pieces 49 are fixed on both inner side walls of the bracket 46. Further, on both upper side of the guide member 43, respective slits 50 are formed on the center of the both side portions of the guide member 43 to protrude the hinges 25 inside the guide member 43. The guide member 43 is installed to the installation pieces 49 of the bracket 46 with the screws 51.

The reverse unit 18B in the fourth embodiment includes the case 18 that houses the reverse path 20, the refeed path 21, the reverse roller 22, the separation pick 23, and the transfer rollers 24, the guide member 43, and the bracket 46 having the pair of first supporting shafts 27.

In the image forming apparatus with the above-described configuration, when the large size sheet is conveyed into the reverse path 20, the leading edge of the sheet is protruded from the opening 39, and is guided along the descending curved guide surface 44 in the direction opposite to the main body case 1.

The guide member 43 also serves as a covering member that covers the bracket 46 that rotatably supports the case 18.

Alternatively, the curved guide surface 44 can be arranged such that the curve of the guide surface 44 descends toward the main body case 1, if the opening 39 opens downward at the bottom part of the reverse unit 18B and at a position apart from the main body case 1.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A duplex unit to reverse a sheet supplied from a sheet discharging outlet of an image forming apparatus and to refeed the sheet to a sheet refeed inlet of the image forming apparatus, the duplex unit comprising:

a case housing a sheet reverse path configured to connect the sheet discharging outlet to the sheet refeed inlet of the image forming apparatus, the sheet reverse path being configured to reverse the sheet supplied from the sheet discharging outlet and refeed the sheet to the sheet refeed inlet, the case being rotatable around a first supporting shaft whereby the case is configured to have an open position and a closed position; and a manual sheet feeding tray that is rotatably supported by a horizontal second supporting shaft whereby the case has an open position configured to allow a sheet to be manually fed to a manual sheet feeding inlet provided on the image forming apparatus and a closed position, wherein the case includes a recess configured to receive the manual sheet feeding tray into the recess without protruding from a side surface of the case when the tray is in the closed position.

2. The duplex unit according to claim 1, wherein the case and the manual sheet feeding tray are configured to be engaged when the manual sheet feeding tray is in the closed position by engaging a concave portion of the case and a convex portion of the manual sheet feeding tray.

3. The duplex unit according to claim 2, wherein the first supporting shaft is horizontal, and the first supporting shaft and the second supporting shaft are located at different positions, and the concave portion is shaped like an oblong such that a manual sheet feeding tray rotational movement orbit of the convex portion, resulting from a rotation of the manual sheet feeding tray, always exists within an area of a case rotational movement orbit of the concave portion, resulting from a rotation of the case.

4. The duplex unit according to claim 3, wherein a depth of the concave portion changes in the longitudinal direction such that a strength of engagement of the concave portion and the convex portion when the case is in the open position is greater than when the case is in the closed position.

5. The duplex unit according to claim 3, wherein a side wall of a portion of the concave portion where the convex portion is positioned when the manual sheet feeding tray is in the closed position is slanted in a direction along the manual sheet feeding tray rotational movement orbit of the convex portion resulting from the rotation of the manual sheet feeding tray around the second supporting shaft.

6. The duplex unit according to claim 2, wherein the first supporting shaft and the second supporting shaft are parallel to an offset from one another, and the concave portion is shaped like an oblong such that a manual sheet feeding tray rotational movement orbit of the convex portion, resulting from a rotation of the manual sheet feeding tray, always exists within an area of a case rotational movement orbit of the concave portion, resulting from a rotation of the case.

7. The duplex unit according to claim 1, wherein the case and the manual sheet feeding tray are configured to be engaged when the manual sheet feeding tray is in the closed position by engaging a concave portion of the case and a convex portion of the manual sheet feeding tray.

8. The duplex unit according to claim 1, wherein the first supporting shaft is arranged below the case.

9. An image forming apparatus, comprising:

a main body case housing an image forming unit;

a reverse unit that includes a case housing a sheet reverse path configured to reverse a sheet having an image formed at the image forming unit on one side of the sheet and to refeed the sheet toward the main body case, the case being rotatably supported such that the case rotates in directions approaching and separating from a side surface of the main body case; and a manual sheet feeding tray that is rotatably supported at one end thereof below the reverse unit and that is configured to rotate from a closed position which is substantially vertical and parallel to a side surface of the case of the reverse unit to an open position to manually feed a sheet, wherein a recess is formed at the side surface of the case of the reverse unit and is configured to receive the manual sheet feeding tray into the recess without protruding from the side surface of the case of the reverse unit when the manual sheet feeding tray is in the closed position.

10. An image forming apparatus, comprising:

a main body case housing an image forming unit, said main body case having a sheet discharge outlet and a sheet refeed inlet;

a reverse unit including a reverse path connecting the sheet discharging outlet to an opening opened downward at a bottom part of the reverse unit, and a refeed path connecting the reverse path to the sheet refeed inlet so as to reverse a sheet conveyed to the reverse path by feeding the sheet to the sheet refeed inlet with a trailing edge of the sheet switched to a leading edge of the sheet, the reverse unit including a reverse unit case;

a bracket rotatably supporting the reverse unit case; and a guide member including a guide surface arranged facing the opening to guide the sheet protruded from the opening, the guide surface being a curved surface formed by an entire upper curved surface of a plurality of ribs integrally formed with the guide member, and the guide member serving as a covering member to cover the bracket.

11. An image forming apparatus, comprising:

a main body case housing an image forming unit, said main body case having a sheet discharge outlet and a sheet refeed inlet;

a reverse unit including a reverse path connecting the sheet discharging outlet to an opening opened downward at a bottom part of the reverse unit, and a refeed path connecting the reverse path to the sheet refeed inlet so as to reverse a sheet conveyed to the reverse path by feeding the sheet to the sheet refeed inlet with a trailing edge of the sheet switched to a leading edge of the sheet; and a manual sheet feeding unit including a sheet feeding section having a guide surface arranged facing the opening to guide the sheet protruded from the opening, and a manual sheet feeding tray rotatably provided at the sheet feeding section and that is configured to receive stacked sheets.

12. An image forming apparatus according to claim 11, wherein the manual sheet feeding unit further comprises;

a sheet feeding roller configured to contact and press on a top sheet of the stacked sheets and to feed the sheet; and a friction pad provided proximate a sheet feeding exit of the manual sheet feeding tray and that is configured to press-contact the sheet feeding roller.

13. An image forming apparatus having an image forming unit and a main body case housing the image forming unit, comprising:

a duplex unit configured to reverse a sheet supplied from the image forming unit and to refeed the sheet to the image forming unit, the duplex including, a case housing a sheet reverse path that connects a sheet discharging outlet to a sheet refeed inlet provided on the main body case and that is configured to reverse the sheet supplied from the sheet discharging outlet and refeed the sheet to the sheet refeed inlet, the case being rotatable around a first supporting shaft where the case is configured to have an open position and a closed position; and a manual sheet feeding tray that is rotatably supported by a horizontal second supporting shaft whereby the open position of the case is configured to allow a sheet to be manually fed to a manual sheet feeding inlet provided on the main body case and the closed position, wherein the case includes a recess configured to receive the manual sheet feeding tray into the recess without protruding from a side surface of the case when the tray is in the closed position.

14. The image forming apparatus according to claim 13, wherein the case and the manual sheet feeding tray are configured to be engaged when the manual sheet feeding tray is in the closed position by engaging a concave portion of the case and a convex portion of the manual sheet feeding tray.

15. The duplex unit according to claim 14, wherein the first supporting shaft is horizontal, and the first supporting shaft and the second supporting shaft are located at different positions, and the concave portion is shaped like an oblong such that a manual sheet feeding tray rotational movement orbit of the convex portion, resulting from a rotation of the manual sheet feeding tray, always exists within an area of a case rotational movement orbit of the concave portion, resulting from a rotation of the case.

16. The image forming apparatus according to claim 15, wherein a depth of the concave portion changes in the longitudinal direction such that a strength of engagement of the concave portion and the convex portion when the case is in the open position is greater than when the case is in the closed position.

17. The image forming apparatus according to claim 15, wherein a side wall of a portion of the concave portion where the convex portion is positioned when the manual sheet feeding tray is in the closed position is slanted in a direction along the manual sheet feeding tray rotational movement orbit of the convex portion resulting from the rotation of the manual sheet feeding tray around the second supporting shaft.

18. The duplex unit according to claim 14, wherein the first supporting shaft and the second supporting shaft are parallel to an offset from one another, and the concave portion is shaped like an oblong such that a manual sheet feeding tray rotational movement orbit of the convex portion, resulting from a rotation of the manual sheet feeding tray, always exists within an area of a case rotational movement orbit of the concave portions, resulting from a rotation of the case.

19. The image forming apparatus according to claim 13, wherein the case and the manual sheet feeding tray are configured to be engaged when the manual sheet feeding tray is in the closed position by engaging a concave portion of the case and a convex portion of the manual sheet feeding tray.

20. The image forming apparatus according to claim 13, wherein the first supporting shaft is arranged below the case.

* * * * *